United States Patent [19]

Sabongi

[11] Patent Number: 4,805,773

[45] Date of Patent: Feb. 21, 1989

[54] LAMINATE MULTIMEDIA SAMPLING DEVICE

[75] Inventor: Gerbran J. Sabongi, Woodbury, Minn.

[73] Assignee: Minnesota Mining and Manufacturing Company, St. Paul, Minn.

[21] Appl. No.: 162,897

[22] Filed: Mar. 2, 1988

[51] Int. Cl.[4] ..... B65D 73/00

[52] U.S. Cl. ..... 206/489; 206/81; 206/581; 206/823

[58] Field of Search ..... 206/486, 484, 488, 489, 206/490, 581, 823, 385, 44.11, 447.1.8, 1.9, 81; 283/56; 132/79 R, 79 A, 88.7

[56] References Cited

U.S. PATENT DOCUMENTS

| | | | |
|---|---|---|---|
| 343,704 | 6/1886 | Drakenfield | 206/486 X |
| 718,296 | 1/1903 | Adamson | 206/1.8 |
| 1,258,308 | 3/1918 | Boss | 206/484 |
| 1,633,444 | 6/1927 | Fruitema | 206/489 X |
| 1,960,669 | 5/1934 | Freedman | 206/81 X |
| 2,061,139 | 11/1936 | Cohen | 206/489 |
| 2,557,141 | 6/1951 | Rebora | 206/484 X |
| 2,561,400 | 7/1951 | Morrell | 206/581 X |
| 2,735,435 | 5/1953 | Feinstein | 132/88.7 |
| 3,212,638 | 10/1965 | Tomlinson | 206/489 |
| 4,611,611 | 9/1986 | Beal | 132/88.7 |

FOREIGN PATENT DOCUMENTS 0197184 10/1986 European Pat. Off. .

*Primary Examiner*—Stephen Marcus
*Assistant Examiner*—Bryon Gehman
*Attorney, Agent, or Firm*—Donald M. Sell; Mark A. Litman

[57] ABSTRACT

A multiplicity of individual samples of various materials are provided from a single article comprising a spacer layer with a multiplicity of holes which expose a number of different samples on support surfaces. Not all of the samples are on the same support surface, the uppermost support surface having holes therein to allow access to samples on lower support surfaces.

14 Claims, 2 Drawing Sheets

LAMINATE MULTIMEDIA SAMPLING DEVICE

BACKGROUND OF THE INVENTION

1. Field of the Invention

The present invention relates to sampling devices which can offer a number of different samples from the same surface. The devices are particularly useful in the sampling cosmetic materials.

2. Background of the Art

It is particularly desirable to be able to sample materials to individuals without resorting to a common carrier or applicator that would come into contact with many different persons. Samples of individual materials have been provided in many different ways including small containers or other carriers with individual units to be dispensed therefrom.

U.S. Pat. No. 2,735,435 shows a device for providing samples of lipstick to an individual. Lipstick is provided to both exterior surfaces of a folded substance with a mask in the shape of lips over the lipstick.

U.S. Pat. No. 4,611,611 shows another device for providing samples of lipstick to an individual. The device has a fold line on both sides of which are samples of lipstick in the shape of upper and lower lips.

Multiple samples have been commercially supplied by printing multiple (e.g., four) stripes of cosmetic material (e.g., eye shadow) on a single sheet and placing a paper cover sheet with a corresponding multiple of holes over the stripes of material. This type of construction allowed for intermixing of ingredients under the cover sheet and requires expensive equipment to print the samples in close proximity.

SUMMARY OF THE INVENTION

A device for providing multiple samples of materials is constructed of a spacer or cover sheet and a number of overlapping or overlaid carrier sheets adhered to the backside of the spacer. Each carrier sheet bears at least one sample which is removable from a surface by pressure or abrasion, as with a finger or brush. The uppermost carrier sheet has holes in it to allow access to samples on lower (with respect to the spacer) sheets. The spacer has a number of holes in it which overlay the samples to allow access to those samples.

DETAILED DESCRIPTION OF THE DRAWINGS

Figure 1:
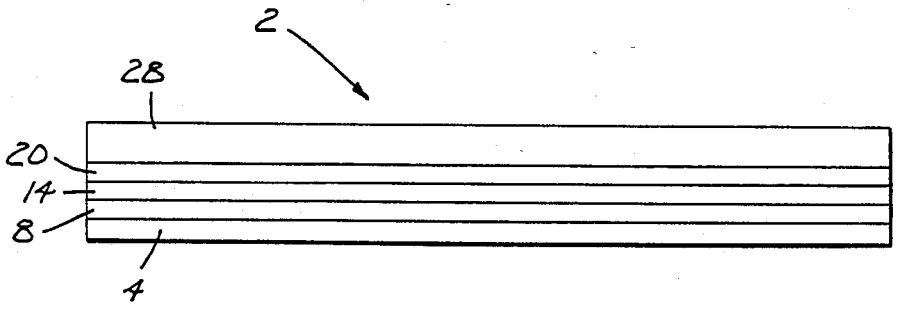
FIG. 1 shows a side view of the multicomponent sampling device of the present invention.

FIG. 1 shows a side view of multicomponent sampling element 2 of the present invention. A first carrier layer 4 carrying a sample to be exposed (not shown) is in contact with a second carrier layer 8, which in turn is in contact with a third carrier layer 14, which is yet again in contact with a fourth carrier layer 20, on top of which is a spacer layer 28.

Figure 2:
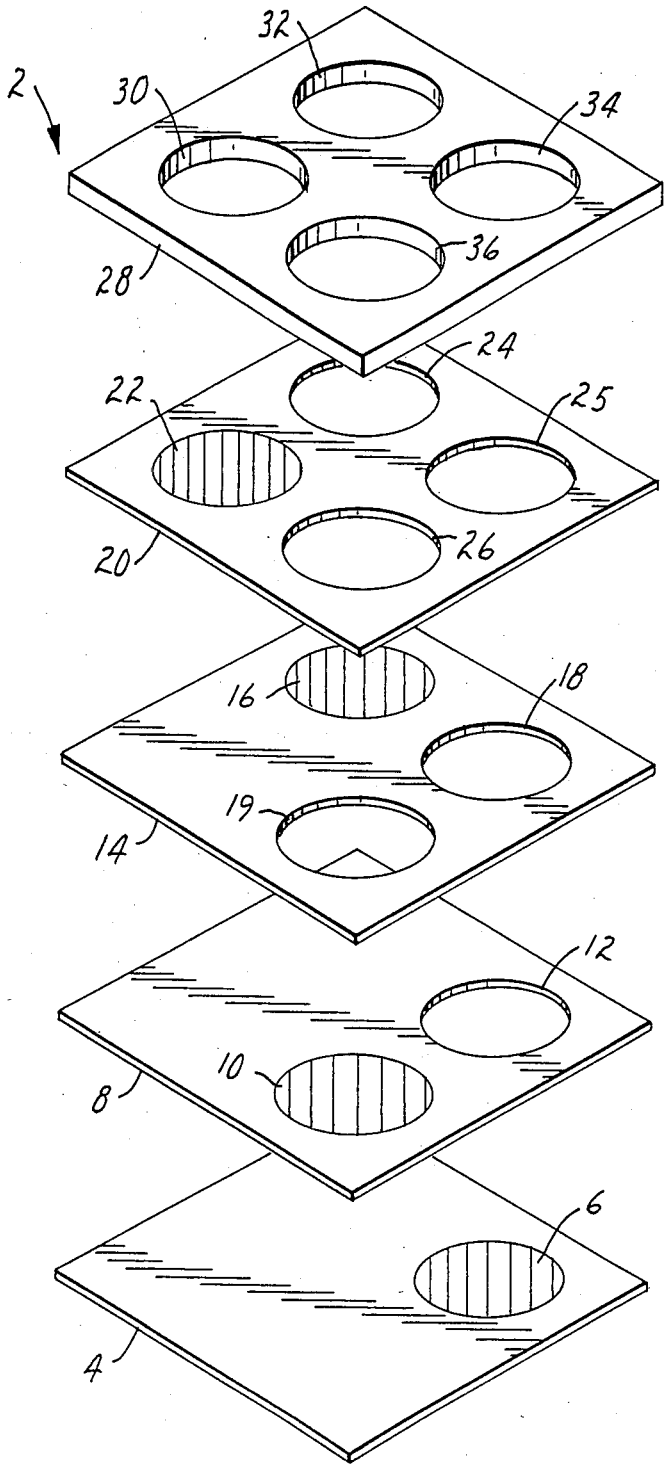
FIG. 2 shows an exploded view of a multicomponent sampling device of the present invention.

FIG. 2 shows a multimodal sampling element 2 of the present invention comprising a lowermost carrier layer 4 having an abrasion or pressure removable samples 6 on one surface thereof. A second abrasion or pressure removable sample (not shown) may be present on this lowermost carrier layer 4 in a corner farthest from the first sample 6 with appropriate modification (placement of holes) in other carrier layers. A second carrier layer 8 is placed over said first carrier layer. There is a hole 10 said second carrier layer 8 which exposes sample 6. Hole 12 need not be identically coextensive with the exposed sample and may be larger than, smaller than or the same size as that sample. On top of said second carrier sheet 8 is a second abrasion or pressure removable sample 10 which is in a different area of said second carrier sheet 8 than is hole 12. On top of said second carrier sheet 8 is a third carrier sheet 14 which has holes 18 and 19 which expose samples 6, and 10 respectively. A third sample 16 is placed on top of said third carrier sheet 14. A fourth carrier sheet 20 is over said third carrier sheet 14. The fourth carrier sheet 20 has three holes 24, 25 and 26 which overlie samples 16, 6 and 10, respectively. A fourth abrasion or pressure rupturable sample 22 is placed in the uncut area of carrier sheet 20. A spacer layer 28 is shown over the three carrier layers 4, 10, and 18. The spacer layer 28 has four holes 30, 32, 34, and 36 which expose samples 6, 16, 8 and 26 respectively.

DETAILED DESCRIPTION OF THE INVENTION

The carrier sheets used in the present invention may be of the same or different materials such as paper, polymeric film, foam, reticulated film, etc. The sheets may be from about 0.01 mm to 5 mm in thickness, preferably from 0.025 to 1 mm in thickness. The carrier sheet should not be highly absorptive of the sample or its ingredients as this would alter the properties or availability of the sample.

The spacer layer may be similarly or differently constituted from the carrier layers and may be composed of paper, film, foam, reticulated foam, cardboard, etc. The spacer is generally at least as thick as the carrier layered and usually is thicker than the carrier layers. If the spacer layer is not to be the thickest layer, then either the first (the layer farthest from the spacer) carrier layer or the second carrier layer should be the thickest layer in the samples composite. The spacer layer would generally be from 0.5 to 15 mm, preferably from 1 to 10 mm.

The individual carrier layers are preferably secured together and secured to the spacer layer. This securement may be by stapling, adhesive, or an edge wrap. Adhesive attachment, as with a pressure sensitive adhesive, thermal adhesive, or solvent activatable adhesive is preferred. Polyamide thermal adhesive and vinyl solvent activated adhesives are preferred.

Printing of the samples may be done with conventional printing, painting or spot extrusion equipment. Cutting of the holes may be done by conventional dye cutting of the carrier sheets.

The samples themselves may be provided in a variety of different forms and may comprise a host of different materials. Lipstick, blush, eyeliner, cover-ups, lotions, creams, sunscreens, repellants, perfumes, colognes, styptics, medication, and the like may be sampled in this type of device. Some materials which are solid or wax-like in consistency may be coated or printed directly onto a carrier sheet. Liquid materials would have to be provided in an enclosed form such as a small plastic packet, closed cell rupturable foam, or microcapsules in a binder medium. Pressure or abrasion of the enclosure would then release the liquid and make it available for removal and subsequent application. Microencapsulation of liquids may be done according to the procedures described in U.S. Pat. Nos. 3,516,941 and 2,041,319 and 2,048,206, for example. The microcapsules may be deposited on the carrier sheet in a binder in a fashion, similar to that described in U.S. Pat. Nos. 4,487,801 and 4,606,956.

Lipstick may be melted and printed onto the surface of the carrier sheet (e.g., by screen printing). A slight heating step after printing can be used to add gloss to the lipstick.

In the process of making the sampling device, it is much easier and a higher quality product results from assembling the device with certain guidelines. The carrier layers should be attached sequentially to the spacer sheet (if it is the thickest, most structurally rigid layer) rather than to each of the other separator layers or carrier layers first. The order of assembly, therefore, would be one carrier layer (generally the one with the most holes therein) being secured to one side of the spacer sheet and the remaining carrier layers being secured to that one carrier sheet or to other carrier sheets after they have been attached thereto.

A typical assemblage would be to have a spacer layer comprised of 7 mm thick polystyrene foam in a 100 mm×100 mm sheet with four 25 mm holes cut therein in a rectangular pattern, and printing on the foam between the holes (such as advertising or decoration). A carrier sheet comprising 0.8 mm paper impregnated with an oleophobic agent has three 25 mm holes cut therein in correspondence with three of the holes in the spacer layer. A circular coating (20 mm diameter) of lipstick is applied to the carrier sheet in an area corresponding to the position on the carrier layer that would underlie the fourth hole in the spacer layer. A solvent based adhesive was applied to the carrier around the three holes and the lipstick sample and the carrier pressed to the spacer. The adhesive was allowed to dry A second carrier sheet comprising 0.8 mm paper having two holes cut therein (corresponding to the position of two of the holes in the first carrier sheet had a rouge composition printed in a 20 mm circle in a position of the second carrier corresponding to the third hole in the first carrier sheet. A solvent based adhesive was applied around the holes and samples and the second carrier sheet was adhered to the backside of the first carrier sheet already bonded to the spacer. The adhesive was again allowed to dry.

A third carrier sheet comprising 0.8 mm paper having two 20 mm circular patches of binder entrapped different microencapsulated fragrances (one a perfume, the other a cologne) printed thereon was coated with a solvent based adhesive around the patches. The position of the patches corresponded to the position of the two holes in the second carrier sheet (preferably diagonally separated from each other). The third carrier sheet was pressed to the back of the second carrier sheet and the adhesive allowed to dry.

Individual samples would be taken from each of the exposed samples areas without readily contacting and contaminating other samples. The thickness of the spacer layer also reduces or prevents accidental contact with the samples and transferral of material.

Other modifications, such as film covers over the holes, protective films, foams or inserts in the holes, and the like are contemplated in the practice of the present invention. The number of holes can vary, of course, with four being a convenient number for discussion, but not limiting the use of five, six, eight or more holes and samples.

What I claim is:

1. A device for providing a number of samples removable by pressure or abrasion comprising:

(a) a spacer layer having a thickness of between 0.5 and 15 mm and at least two holes therein, (b) a topmost carrier layer having at least one pressure or abrasion removable sample thereon, said carrier being secured to said spacer and said at least one sample aligned with one of said at least two holes in said spacer layer, and said topmost carrier layer having a hole therein which is aligned with another of said at least two holes in said spacer layer, and (c) a next topmost carrier layer having at least one pressure or abrasion removable sample thereon, said next topmost carrier being secured to said topmost carrier and said at least one pressure or abrasion removable sample on said next topmost layer being aligned with said another of said at least two holes in said spacer layer.

2. The device of claim 1 wherein at least one of said samples is lipstick.

3. The device of claim 2 wherein said spacer layer has at least three holes therein.

4. The device of claim 3 wherein said layers are secured by adhesive means.

5. The device of claim 2 wherein said spacer layer has at least four holes therein.

6. The device of claim 5 wherein said layers are secured by adhesive means.

7. The device of claim 2 wherein said layers are secured by adhesive means.

8. The device of claim 1 wherein at least one of said samples is a microencapsulated material secured to a carrier sheet by a binder.

9. The device of claim 8 wherein said spacer layer has at least three holes therein.

10. The device of claim 8 wherein said spacer layer has at least four holes therein.

11. The device of claim 8 wherein said layers are secured by adhesive means.

12. The device of claim 1 wherein said spacer layer has at least three holes therein.

13. The device of claim 1 wherein said spacer layer has at least four holes therein.

14. The device of claim 1 wherein said layers are secured by adhesive means.

* * * * *